US006692826B2

(12) United States Patent
Shin et al.

(10) Patent No.: US 6,692,826 B2
(45) Date of Patent: Feb. 17, 2004

(54) PLEXIFILAMENTARY STRANDS OF POLYESTER

(75) Inventors: Hyunkook Shin, Wilmington, DE (US); Joseph Robert Guckert, Chester, VA (US); Joseph V. Kurian, Newark, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/135,781

(22) Filed: Apr. 30, 2002

(65) Prior Publication Data

US 2002/0172822 A1 Nov. 21, 2002

Related U.S. Application Data

(62) Division of application No. 09/533,397, filed on Mar. 22, 2000, now Pat. No. 6,458,304.

(51) Int. Cl.[7] ..... D01F 6/00

(52) U.S. Cl. ..... 428/364; 428/373; 428/374; 525/177

(58) Field of Search ..... 428/364, 373, 428/374; 525/177

(56) References Cited

U.S. PATENT DOCUMENTS

| | | | | |
|---|---|---|---|---|
| 3,081,519 | A | 3/1963 | Blades et al. | |
| 3,227,664 | A | 1/1966 | Blades et al. | |
| 3,227,784 | A | 1/1966 | Blades et al. | |
| 3,227,794 | A | 1/1966 | Anderson et al. | |
| 3,375,211 | A | 3/1968 | Parrish | |
| 3,401,140 | A | 9/1968 | Blades et al. | |
| 3,851,023 | A | 11/1974 | Brethauer et al. | |
| 5,147,586 | A | 9/1992 | Shin et al. | |
| 5,254,400 | A | 10/1993 | Bonner, Jr. et al. | |
| 5,795,651 | A | 8/1998 | Matsuoka et al. | |
| 6,096,421 | A * | 8/2000 | Waggoner et al. | 428/364 |
| 6,482,484 | B1 * | 11/2002 | Brown et al. | 525/177 |

FOREIGN PATENT DOCUMENTS

| | | |
|---|---|---|
| JP | 257012 | 9/1994 |
| WO | WO 97/25459 A1 | 7/1997 |

* cited by examiner

*Primary Examiner*—N. Edwards

(57) ABSTRACT

A process for producing plexifilamentary or foam products by flash spinning in selected spin agents a polymer from the group consisting of poly (1,3-propylene terephthalate), poly (1,4-butylene terephthalate), and poly(ethylene terephthalate), including their copolymers in which the spin agents have minimal or no ozone-depleting properties.

6 Claims, 6 Drawing Sheets

2GT IN DICHLOROMETHANE

50% 2GT IN DCE

3GT IN HCFC-122

4GT IN HCFC-122

20% 3GT in HCFC-122

PLEXIFILAMENTARY STRANDS OF POLYESTER

REFERENCES TO RELATED APPLICATIONS

This is a divisional application of U.S. patent application Ser. No. 09/533,397 filed Mar. 22, 2000, now U.S. Pat. No. 6,458,304.

BACKGROUND OF THE INVENTION

1. Field of the Invention

This invention relates to flash spinning of plexifilamentary film-fibril strands of polyester. This invention also relates to a spin fluid that may be used in existing commercial equipment with minimum changes in the equipment and to a spinning process using existing commercial equipment in which the spinning process utilizes compounds having very low ozone depletion potential, and the compounds are either non-flammable or exhibit very low flammability.

2. Description of the Related Art

U.S. Pat. No. 3,081,519 to Blades and White describes a flash spinning process for producing plexifilamentary film-fibril strands from fiber-forming polymers. A solution of the polymer in a liquid, which is a non-solvent for the polymer at or below its normal boiling point, is extruded at a temperature above the normal boiling point of the liquid and at autogenous or higher pressure into a medium of lower temperature and substantially lower pressure. This flash spinning causes the liquid to vaporize and thereby cool the extrudate which forms a plexifilamentary film-fibril strand of the polymer. Preferred polymers typically include crystalline polyhydrocarbons, such as polyethylene and polypropylene.

According to Blades and White, a suitable liquid for flash spinning (a) has boiling point that is at least 25° C. below the melting point of the polymer; (b) is substantially unreactive with the polymer at the extrusion temperature; (c) should be a solvent for the polymer under the pressure and temperature set forth in the patent (i.e., these extrusion temperatures and pressures are respectively in the ranges of 165 to 225° C. and about 500 to 1500 psia (3447–10342 kPa)); (d) should dissolve less than 1% of the polymer at or below its normal boiling point; and (e) should form a solution that will undergo rapid phase separation upon extrusion to form a polymer phase that contains insufficient solvent to plasticize the polymer.

Commercial flashspun products have been made primarily from polyethylene plexifilamentary film-fibril strands and have typically been produced using trichlorofluoromethane as a spin agent. However, it would be desirable to make flashspun products from other types of polymers, such as polyesters, for example that have different properties than polyethylene.

Flash spinning of some types of polyester is known. U.S. Pat. No. 3,401,140 to Blades et al. discloses 10–80 weight percent of poly(ethylene terephthalate) in methylene chloride or in a mixture of methylene chloride and a perhaloalkane. U.S. Pat. No. 3,227,784 to Blades discloses poly (ethylene terephthalate) in mixtures of methylene chloride with cyclohexane, dichloro-difluoromethane, or dichlorotetrafluoroethane.

Japanese Patent Publication J06257012, Sep. 13, 1994, discloses that a highly fibrillated network of fibers can be made of poly(ethylene terephthalate). The poly(ethylene terephthalate) may be present at 5–30% weight percent and flashspun from methylene chloride. The reference also states that poly(1,4-butylene terephthalate) can be used to make such fiber networks, but does not provide any details beyond the bare disclosure.

International Patent Publication WO 97/25459 (Jul. 17, 1997) assigned to E. I. du Pont de Nemours and Company (DuPont) is directed to plexifilamentary strands of various polyester blends, for example, poly(1,4-butylene terephthalate) (4GT) with poly(ethylene terephthalate) (2GT) and 4GT with poly(1,3-propylene terephthalate) (3GT). Poly(1,3-propylene terephthalate) may also be referred to as poly(trimethylene terephthalate). The reference also discloses plexifilamentary strands of polyester blended with various other polymers as well as 100% 4GT. The flash spinning was done using either a mixture of $CO_2$ and water or solvents such as methylene chloride mixed with decafluoropentane (HFC-4310mee).

Microcellular and ultramicrocellular foams of 2GT are disclosed in U.S. Pat. No. 3,227,664 to Blades; U.S. Pat. No. 3,375,211 to Parrish; and U.S. Pat. No. 5,254,400 to Bonner et al., all assigned to DuPont. The solvents used were methylene chloride or mixtures of methylene chloride and dichloro-difluoromethane.

SUMMARY OF THE INVENTION

The invention includes a process for the preparation of plexifilamentary film-fibril strands of synthetic fiber-forming polymer which comprises flash spinning synthetic fiber-forming polyesters of poly(1,3-propylene terephthalate), copolymers of poly(1,3-propylene terephthalate), poly(1,4-butylene terephthalate) and copolymers of poly(1,4-butylene terephthalate). Spin agents that can be used include 1,1,2-trichloro-2,2-difluoroethane and isomers thereof; 1,2-dichloroethylene; and dichloromethane.

The invention includes a spin fluid comprising polyesters of poly(1,3-propylene terephthalate), copolymers of poly(1,3-propylene terephthalate), poly(1,4-butylene terephthalate) and copolymers of poly(1,4-butylene terephthalate) and selected spin agents as listed above.

The invention also includes processes for making microcellular and ultramicrocellular foams made from poly (ethylene terephthalate), poly(1,3-propylene terephthalate), or poly(1,4-butylene terephthalate).

The invention further includes processes for making blends of polyethylene with poly(ethylene terephthalate), poly(1,3-propylene terephthalate) or poly(1,4-butylene terephthalate).

DETAILED DESCRIPTION OF THE INVENTION

Processes for making plexifilamentary products of certain types of polyester are known, however, there are certain processes that have not heretofore been disclosed. As noted above, U.S. Pat. No. 3,081,519 provides a typical process for flash spinning.

The term "plexifilamentary strand", as used herein, means a strand which is characterized as a three-dimensional integral network of a multitude of thin, ribbon-like, film-fibril elements of random length and with a mean film thickness of less than about 4 micrometers and a median fiber width of less than about 25 micrometers, that are generally coextensively aligned with the longitudinal axis of the strand. In plexifilamentary strands, the film-fibril elements intermittently unite and separate at irregular intervals in various places throughout the length, width and thickness of the strand to form the three-dimensional network.

A polyester polymer particularly useful in making the plexifilamentary strands of the invention is poly(1,3-propylene terephthalate) (3GT polyester). Previously, 3GT had not been readily available because an ingredient used to make it, 1,3-propanediol, was itself difficult to make. Recent developments in the production of 1,3-propanediol have made 3GT more readily available for uses as provided herein. It has been found that certain solvents are particularly suited for making the 3GT plexifilamentary strands of the subject invention, i.e., 1,1,2-trichloro-2,2-difluoroethane (HCFC-122) and isomers thereof, 1,2-dichloroethylene (DCE), dichloromethane (or methylene chloride), and also mixtures of HCFC-122 and dichloromethane and mixtures of DCE and dichloromethane. Dichloromethane is a very good solvent for polyesters and may be used as a primary spin agent or as a co-spin agent with DCE or with HCFC-122 to lower the cloud point pressure of the mixture as may be needed. It should be noted that the 1,2-dichloroethylene can be present in either cis- or trans-form.

Figure 6:
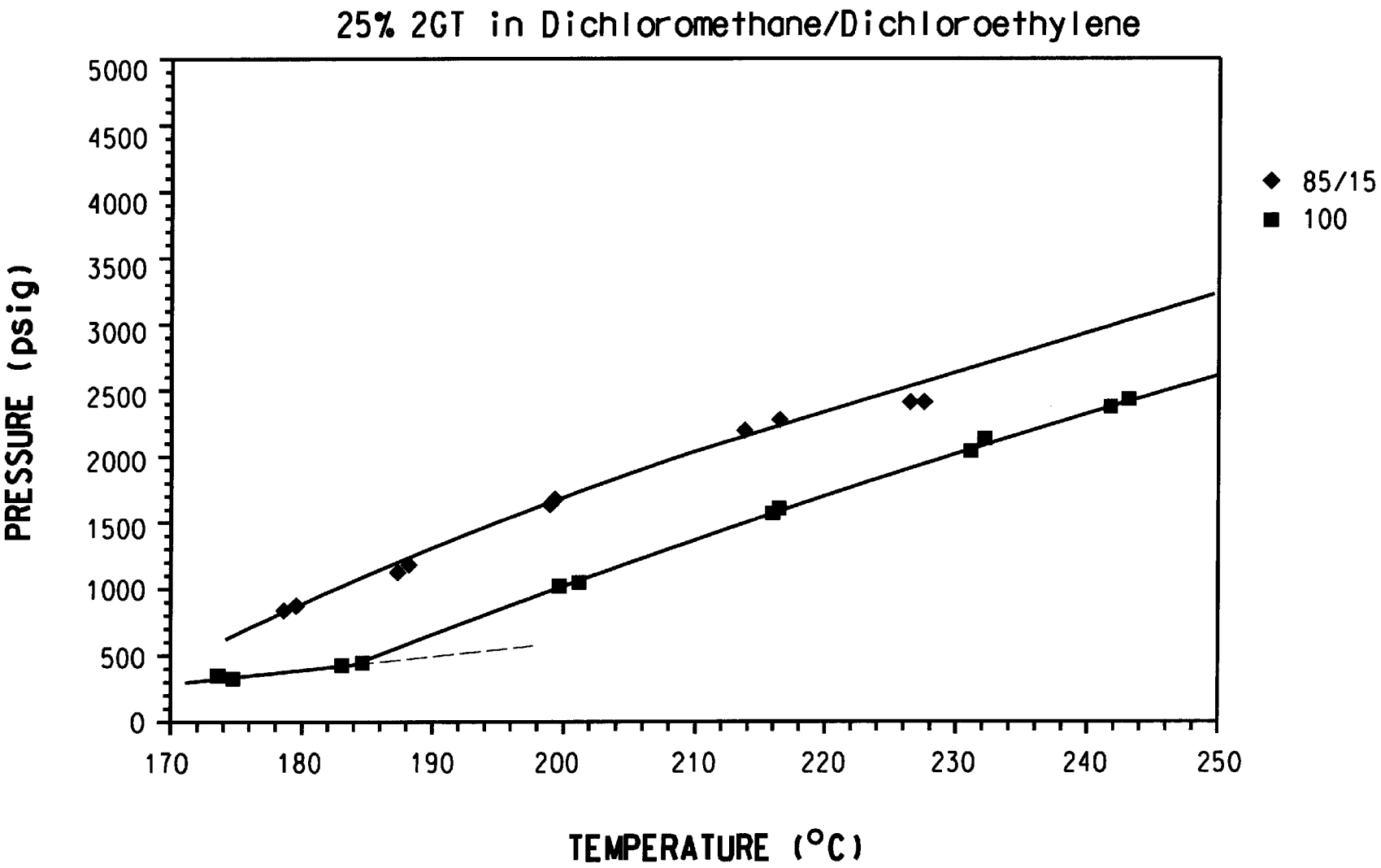
FIG. 6 is a plot of the cloud point data for a solution comprised of 25 weight percent of 26T in dichloroethylene/DCM.

Although dichloromethane is a good flash spinning agent for polyesters, it has relatively low dielectric strength (about 45 KV/cm). U.S. Pat. No. 3,851,023 to Brethauer et al. discloses that in the production of plexifilamentary webs it is advantageous to subject the flashspun strands to an electrostatic charge. This helps to keep the web pinned to the transporting belt. As such, it is desirable that the spin agent have an acceptable suitable dielectric strength. Therefore, in a commercial operation the maximum throughput rate obtainable with dichloromethane as a spin agent would be limited. To obtain high throughput rates, it would be necessary to add a co-spin agent which has a high dielectric strength such as DCE (about 105 KV/cm) or HCFC-122 (about 110 KV/cm) so that good electrostatic charging and pinning of the webs onto the belt could be achieved. FIG. 6 shows cloud point curves for 2GT in 100% dichloromethane and for 2GT in 85% dichloromethane primary spin agent with 15% DCE co-spin agent. The figure illustrates, for example, that the use of DCE as a co-spin agent provides conditions suitable to flash spin good plexifilamentary film fibrils.

Also, poly(1,4-butylene terephthalate)(4GT polyester) has been found useful. Solvents suitable for making plexifilamentary strands of 4GT include HCFC-122 and DCE. DCE and HCFC-122 are good spin agents for both 3GT and 4GT and well fibrillated plexifilaments can be obtained by flash spinning at a temperature range of 200–240° C. This is shown by the cloud point curves in FIGS. 3–4, which show various amounts of 3GT and 4GT in HCFC-122.

The polyester is present in the solvent at 5–30 weight percent based on the total weight of the spin fluid when plexifilamentary fibers are prepared. The term spin fluid as used herein means the solution comprising the fiber-forming polymer, the primary spin agent, any co-spin agent that may be present, plus any additives that may be present. The term spin mixture may also be used to refer to the spin fluid. Unless noted otherwise, the term weight percent (wgt. %) as used herein refers to the percentage by weight based on the total weight of the spin fluid. The polyester can also be present in the solvent in the range of 10 to 25 wgt. %. Further, the polyester can be present in the solvent in the range of 20 to 25 wgt. %.

The term "cloud-point pressure" as used herein, means the pressure at which a single phase liquid solution starts to phase separate into a polymer-rich/spin agent-rich two-phase liquid/liquid dispersion. However, at temperatures above the critical point, there cannot be any liquid phase present and therefore a single phase supercritical solution phase separates into a polymer-rich/spin agent-rich, two-phase gaseous dispersion.

Certain blended polymer plexifilamentary fibers have been flash spun from a polymer and a solvent solution using a process as generally described in U.S. Pat. No. 3,227,794 to Anderson et al. The apparatus used for solution flash spinning in the examples below was a laboratory scale batch spinning unit that is described below and also in U.S. Pat. No. 5,147,586 to Shin et al. It is anticipated that in commercial applications, certain of the blended polymer plexifilaments of the invention could be solution flash spun using the apparatus disclosed in U.S. Pat. No. 3,851,023 to Brethauer et al.

It has been found that certain polyesters, e.g., 3GT and also 2T and 4GT, can be blended with polyethylene and flash spun using a suitable spin agent to obtain plexifilamentary fibers having desirable properties. To obtain the desired 3GT blends, a mixture of 5 to 95 wgt. % 3GT and 95 to 5 wgt. % high-density polyethylene, based on the total weight of the blend mixture was used. The 3GT blends of polyester plus polyethylene were flashspun in dichloromethane spin agent and consisted of 20 wgt. % of the spin fluid. Also, blends were made from polyethylene with either 2GT or with 4GT, wherein the polyester and the polyethylene were present in the blend at about 50/50 (wgt/wgt). These blends of the polyester plus polyethylene were flashspun in dichloroethylene spin agent and consisted of about 20 wgt. % of the spin fluid. Either high density or low density polyethylene could be used with the subject blends. It is known that 2GT is practically insoluble in DCE, e.g. the cloud point pressure would be in excess of 4500 psig. Also, 4GT is not particularly soluble in DCE, e.g. the cloud point pressure would be in excess of 2500 psig. As such, it is surprising that well-fibrillated plexifilaments of 2GT or 4GT blended with polyethylene can be obtained with DCE as a spin agent.

Microcellular and ultramicrocellular foams can be obtained by flash spinning and are usually prepared at relatively high polymer concentrations in the spinning solution, i.e., at least 40 wgt. % of 2GT, 3GT or 4GT polyester. The microcellular and ultramicrocellular foams of this invention have densities between 0.005 and 0.50 gm/cc.

The cells for microcellular foams are generally of a polyhedral shape and their average cell size is less than about 300 micrometers, preferably less than about 150 micrometers. The cell walls are typically less than about 3 micrometers, preferably less than about 2 micrometers in thickness. The ultramicrocellular foams are typically more uniform and of a smaller size. Typical ultramicrocellular foams have an average cell size of less than 50 micrometers and the cell wall thickness is less than 1 micrometer. Hereafter, for the sake of convenience the term foams is meant to include both microcellular and ultramicrocellular foams.

Figure 1:
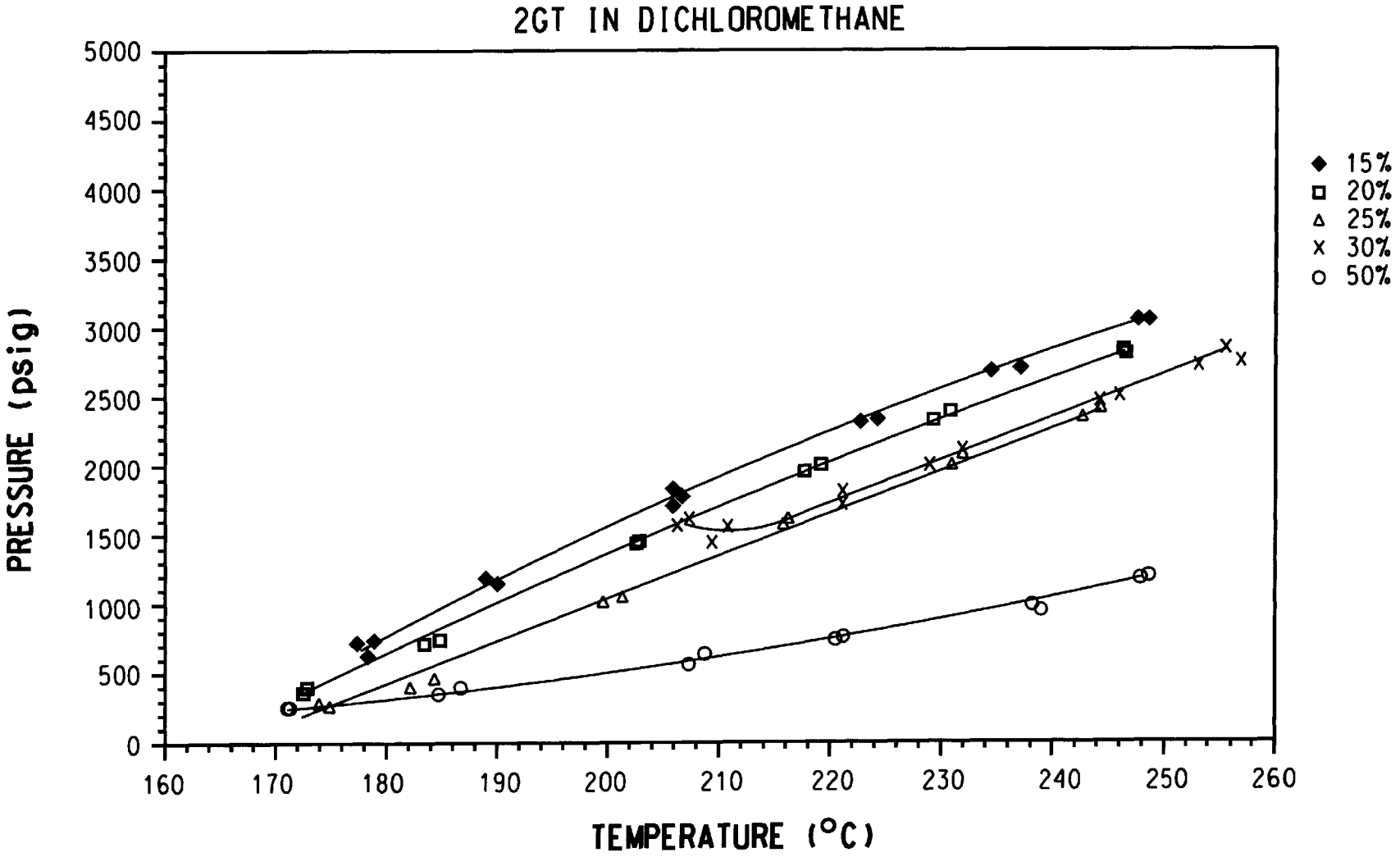
FIG. 1 is a plot of the cloud point data for a solution comprised of various weight percentages of 2GT in dichloromethane.
Figure 2:
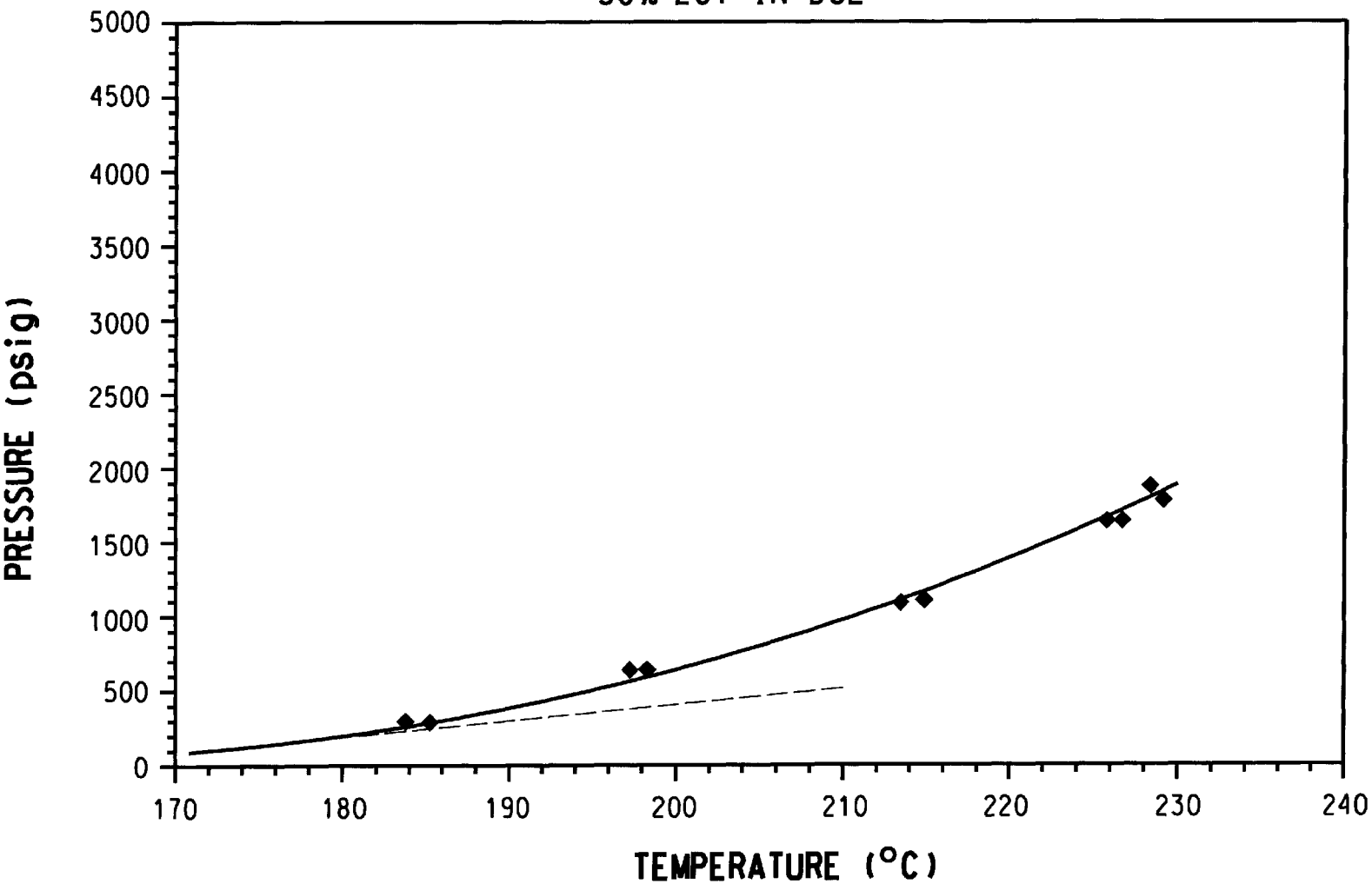
FIG. 2 is a plot of the cloud point data for a solution comprised of 2GT in DCE.
Figure 3:
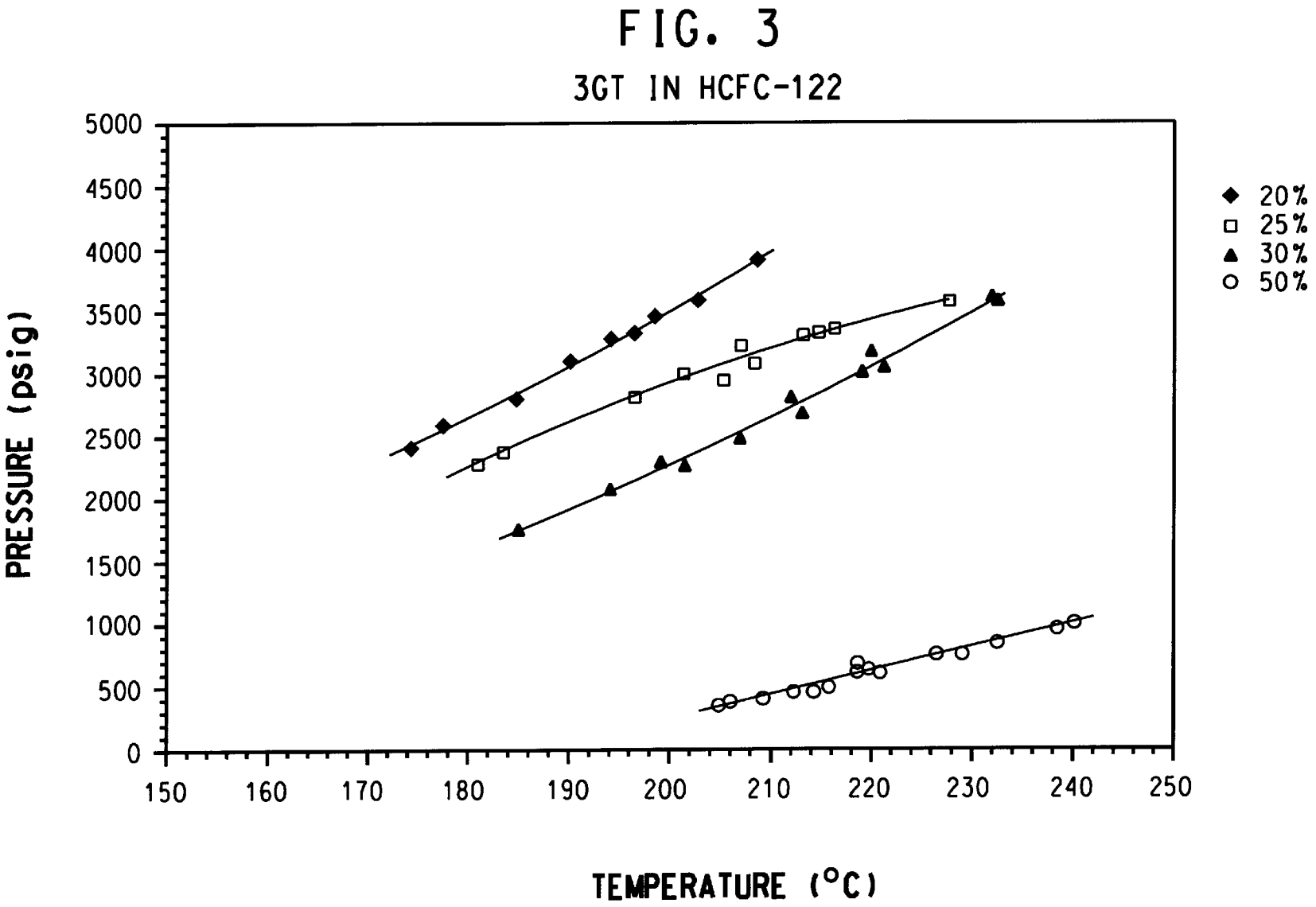
FIG. 3 is a plot of the cloud point data for a solution comprised of various weight percentages of 3GT in HCFC-122.
Figure 4:
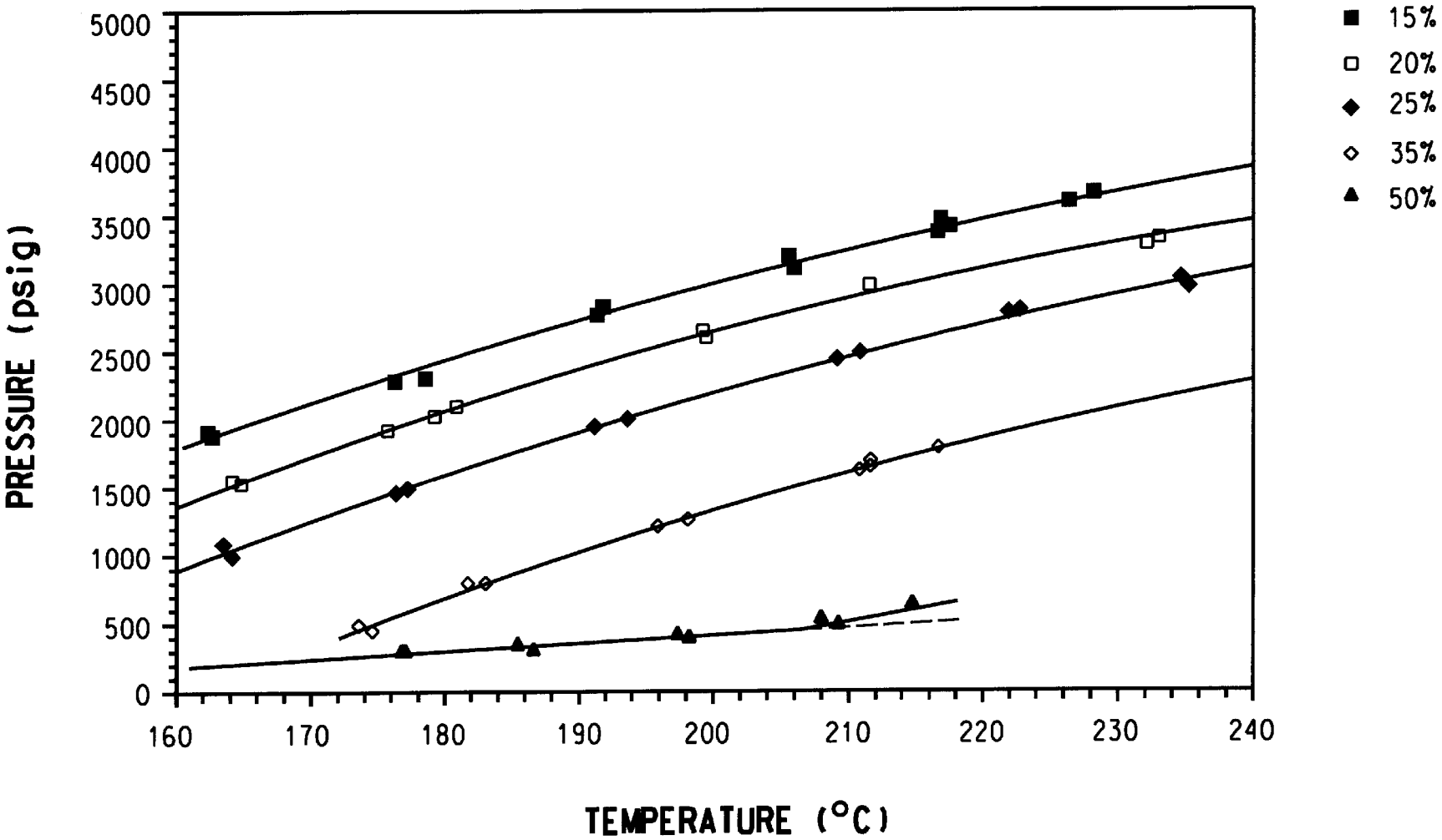
FIG. 4 is a plot of the cloud point data for a solution comprised of various weight percentages of 4GT in HCFC-122.

It is known that 2GT polyester does not typically form acceptable plexifilamentary strands, except with dichloromethane as the spin agent. With other spin agents, such as DCE or HCFC-122, the spin pressure would be too high, e.g., in excess of 5000 psi, when less than 30 wgt. % polymer concentration is used to obtain plexifilaments. However, it has been found that at the higher concentrations of polyester (typically 40 wgt. % or greater) used for flash spinning foams, 2GT is sufficiently soluble in other solvents, such as DCE and HCFC-122, to provide spin fluids which can be flash spun to make foams as shown in FIGS. 2–4. FIG. 1 shows that 2GT in dichloromethane exhibits an acceptable range of cloud points, irrespective of the amount of 2GT.

Foams may be formed at relatively low spinning temperatures; and typical spinning pressures used are above the cloud point pressure. However, foam fibers may be obtained rather than plexifilaments even at spinning pressures slightly below the cloud point pressure of the solution. Spin agents and co-spin agents are the same as those noted above for the plexifilamentary, film-fibril materials. Nucleating agents, such as fumed silica and kaolin, can be added to the spin mixture to facilitate spin agent flashing and to obtain uniform, small-sized cells.

Foams can be obtained in a collapsed form or in a fully or partially inflated form. For many polymer/solvent systems, foams tend to collapse after exiting the spinning orifice as the solvent vapor condenses inside the cells and/or diffuses out of the cells. To obtain low density inflated foams, inflating agents having low boiling temperatures are usually added to the spin fluid. Suitable inflating agents that can be used include partially halogenated hydrocarbons, such as, hydrochlorofluorocarbons and hydrofluorocarbons; perfluorocarbons; and hydrofluoroethers. Other organic solvents and gases having low boiling temperatures can be used. When very low density foams (0.0005–0.1 g/cm$^3$) are desired, as-spun foams can be post-inflated using the procedures described in Blades, Parrish and Bonner.

Foam fibers are normally spun from a round cross section spin orifice. However, an annular die similar to the ones used for blown films can be used to make foam sheets.

Figure 5:
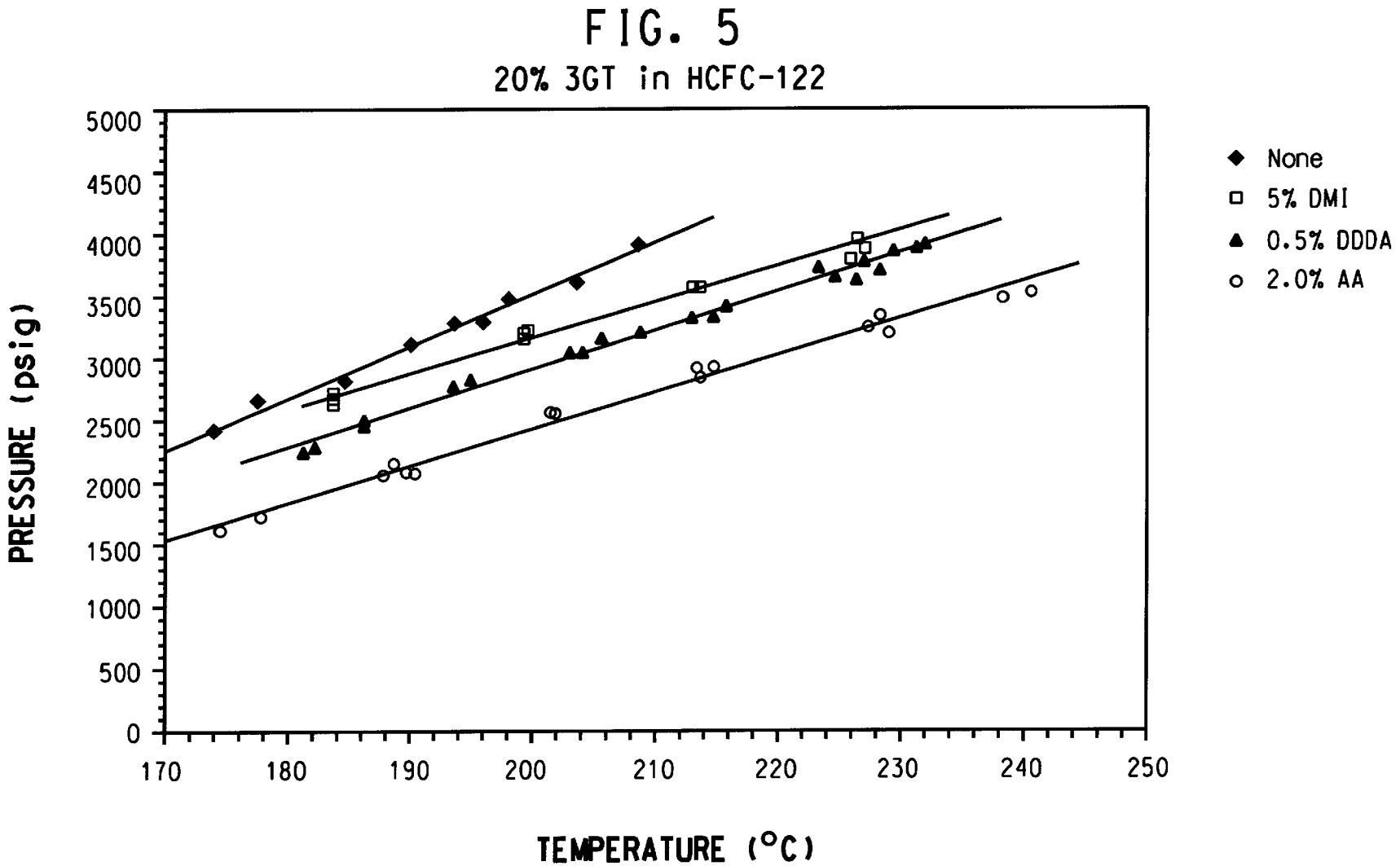
FIG. 5 is a plot of the cloud point data for a solution comprised of 20 weight percent of various 3GT copolymers in HCFC-122.

It should be noted that the 2GT, 3GT, and 4GT polymers herein are intended to include copolymers with recurring units of up to about 15% monomer as well as homopolymers whether used for making foams or plexifilaments. Moreover, it has been found that the addition of monomers to a homopolymer can decrease the cloud point pressure such that the resulting copolymer can be flash spun at a lower temperature and pressure. This is demonstrated in FIG. 5 which presents cloud point curves for various amounts of monomers added to 3GT. The comonomers added were dimethyl isophathalate (DMI), dodecanedioic acid (DDDA) and adipic acid (AA).

EXAMPLES

Test Methods

In the description above and in the non-limiting examples that follow, the following test methods were employed to determine various reported characteristics and properties. ASTM refers to the American Society of Testing Materials.

The intrinsic viscosity of the 2GT and 3GT polymer samples was measured at 19° C. using a Viscotek Forced Flow Viscometer Model Y-900. The samples were dissolved in 50/50 (wt/wt) trifluoroacetic acid/dichloromethane at room temperature at a polymer concentration of 0.4 g/dl. The viscosity data (dl/g) reported represents correlated intrinsic viscosity values in 60/40 (wt/wt) phenol/1,1,2,2-tetrachloroethane following ASTM D-4603-96.

The denier of the strand was determined from the weight of a 15 cm sample length of strand under a predetermined load.

Tenacity and elongation of the flashspun strand were determined with an Instron tensile-testing machine. The strands were conditioned and tested at 70° F. (21° C.) and 65% relative humidity. The strands were then twisted to 10 turns per inch (about 4 turns per centimeter) and mounted in the jaws of the Instron Tester. A two-inch (5.08 cm) gauge length was used with an initial elongation rate of 4 inches per minute (10.2 centimeters per minute). The tenacity at break is recorded in grams per denier (gpd). The elongation at break is recorded as a percentage of the two-inch gauge length of the sample. Modulus corresponds to the slope of the stress/strain curve and is expressed in units of gpd.

The surface area of the plexifilamentary film-fibril strand product is another measure of the degree and fineness of fibrillation of the flashspun product. Surface area is measured by the BET nitrogen absorption method of S. Brunauer, P. H. Emmett and E. Teller, J. Am. Chem. Soc., V. 60 p 309–319 (1938) and is reported as m$^2$/g.

Test Apparatus for Examples 1–41

The apparatus used in the Examples is the spinning apparatus described in U.S. Pat. No. 5,147,586. The apparatus consists of two high-pressure cylindrical chambers, each equipped with a piston which is adapted to apply pressure to the contents of the chamber. The cylinders have an inside diameter of 1.0 inch (2.54 cm) and each has an internal capacity of 50 cubic centimeters. The cylinders are connected to each other at one end through a 3/32 inch (0.23 cm) diameter channel and a mixing chamber containing a series of fine mesh screens that act as a static mixer. Mixing is accomplished by forcing the contents of the vessel back and forth between the two cylinders through the static mixer. The pistons are driven by high-pressure water supplied by a hydraulic system. A spinneret assembly with a quick-acting means for opening the orifice is attached to the channel through a tee. The spinneret assembly consists of a lead hole of 0.25 inch (0.63 cm) diameter and about 2.0 inch (5.08 cm) length, and a spinneret orifice with a length and a diameter each measuring 30 mils (0.762 mm). A spinneret orifice with a length and a diameter each measuring 30 mils (0.762 mm) was used for all the examples, except Examples 17 and 19. In Example 17, the spinneret orifice had a length and a diameter each measuring 15 mils (0.381 mm). In Example 19, the spinneret orifice had a length of 30 mils (0.762 mm) and a diameter of 15 mils (0.381 mm).

In the tests reported in Examples 1–20 and 41, the apparatus described above was charged with pellets of a polyester and a spin agent. For Examples 21–40, the apparatus was also charged with high density polyethylene, in addition to the polyester. The high-pressure water was used to drive the pistons to generate a mixing pressure of between 1500 and 4500 psig (10,239–30,717 kPa). The polymer and spin agent were then heated to mixing temperature and held at that temperature for a specified period of time during which the pistons were used to alternately establish a differential pressure of about 50 psi (345 kPa) or higher between the two cylinders so as to repeatedly force the polymer and spin agent through the mixing channel from one cylinder to the other to provide mixing and to effect formation of a spin mixture. The spin mixture temperature was then raised to the final spin temperature, and held there for a time sufficient to equilibrate the temperature, during which time mixing was continued. However, the time was kept as short as possible at the subject temperatures to avoid degradation of the polymer or the spin agent. It should be noted that when a range of temperatures is given for a particular example, the mixing time was measured from the starting temperature indicated until the solution was flash spun. In order to simulate a pressure letdown chamber, the pressure of the spin mixture was reduced to a desired spinning pressure just prior to spinning. This was accomplished by opening a valve between the spin cell and a much larger tank of high-pressure water ("the accumulator") held at the desired spinning pressure. the spinneret orifice was opened as soon as possible (usually about one to two seconds) after the opening of the valve between the spin cell and the accumulator. This period was intended to simulate the residence time in the letdown chamber of a large-scale spinning apparatus. The resultant flashspun product was collected in a stainless steel open mesh screen basket. The pressure recorded during spinning just before the spinneret was entered as the spin pressure. The pressure was recorded using a computer.

It is noted that pressures may be expressed as psig (pounds per square inch gage) which is approximately 15 psi less than psia (pounds per square inch absolute). The unit psi is considered the same as psia. For converting to SI units, 1 psi=6.9 kPa. When an item of data was not measured or was not available, it is noted in the tables as N.M. or N.A., respectively.

Particularly in the tables that follow, the amount of primary spin agent and co-spin agent may be expressed at times as their percentage by weight of the combined weight of the primary spin agent and the co-spin agent. Weston 619F, a diphosphite thermal stabilizer from GE Specialty Chemicals, was added at 0.1 weight percent, based on total spin agent for each of the following plexifilamentary Examples 1–9 and 19–41. The stabilizer was not added to the foam Examples 10–18 unless so noted. Other ingredients were added as noted.

Examples 1–3

In Examples 1–3, 3GT was flash spun using either HCFC-122 or a mixture of HCFC-122 and dichloromethane as the spin agent. The 3GT polymer was prepared from terephthalic acid and 1,3-propanediol with TYZOR®TPT (tetraisopropyl titanate) as the polycondensation catalyst, using methods known in the art. TYZOR®TPT is available from DuPont. The as-prepared polymer had an intrinsic viscosity of 0.76 dl/g. The polymer was solid phase polymerized at 205° C. under nitrogen to obtain an instrinsic viscosity of 1.53 dl/g.

In Example 1, a spin mixture was prepared containing 20 weight percent of 3GT polymer in HCFC-122 spin agent. Cab-o-sil N70-TS colloidal silica was added as a nucleating agent at 1.0 weight percent, based on polymer weight.

In Examples 2–3, the spin mixture contained 15 weight percent 3GT, based on total spin mixture weight, in a 50/50 (wgt/wgt) mixture of HCFC-122 and dichloromethane.

Plexifilamentary fibers were obtained by flash spinning the spin mixtures using the conditions given in Table 1 below. In Example 3, a spin tunnel having a diameter of 200 mils (0.51 cm) and a length of 100 mils (0.25 cm) was used outside of the spinneret. Mechanical properties of the plexifilaments are also reported in Table 1.

Examples 4–5

In Examples 4 and 5, plexifilaments were flash spun from a spin mixture containing 20 weight percent 3GT, based on total weight of the spin mixture, and a spin agent which was either trans-1,2-dichloroethylene (DCE) (Example 4) or a 50/50 (w/w) mixture of DCE and dichloromethane (Example 5). Cab-o-sil N70-TS fumed silica nucleating agent (Cabot Corporation, Boston, Mass.) was also added to each of the spin mixtures at 1.0 weight percent, based on polymer.

The 3GT polymer used in Example 4 had an intrinsic viscosity of 1.70 dl/g and was obtained by solid phase polymerization (205° C., nitrogen) of the as-prepared polymer (0.76 dl/g intrinsic viscosity) described in Examples 1–3 and had an intrinsic viscosity of 1.70 dl/g. The 3GT polymer used in Example 5 was also solid phase polymerized (205° C., nitrogen) from the same starting polymer and had an intrinsic viscosity of 1.87 dl/g.

Plexifilaments having a BET surface area of 4.1 $m^2/g$ for Example 4 and a surface area of 2.0 $m^2/g$ for Example 5 were obtained by flash spinning the spin mixtures using the conditions given in Table 1 below. Plexifilament mechanical properties are also reported in Table 1.

Example 6

This example demonstrates flash spinning of 3GT using dichloromethane as the spin agent. A spin mixture was prepared containing 25 weight percent of the 3GT polymer described in Examples 1–3.

Plexifilaments having a BET surface area of 9.23 $m^2/g$ were obtained by flash spinning the spin mixtures using the conditions given in Table 1 below. Plexifilament mechanical properties are also reported in Table 1.

TABLE 1

3GT Plexifilamentary Fibers

| Ex. No. | Solvent | Temp (° C.) | Mixing min | Mixing Back P (psig) | Mixing ΔP (psig) | Spinning Accum P (psig) | Spinning Spin P (psig) | Spinning Temp (° C.) | Fiber Properties @ 10 tpi gms load | Den | Ten (gpd) | E (%) | Modulus (gpd) |
|---|---|---|---|---|---|---|---|---|---|---|---|---|---|
| 1 | HCFC-122 | 170–210 | 32 | 4500 | 150 | 3600 | 3300 | 211 | 40 | 1064 | 0.46 | 82 | 2.03 |
| 2 | 50/50 HCFC-122/$CH_2Cl_2$ | 180–220 | 17 | 3200 | 250 | 2400 | 2250 | 221 | 50 | 580 | 0.47 | 100 | 1.23 |
| 3 | 50/50 HCFC-122/$CH_2Cl_2$ | 180–243 | 17 | 3600 | 250 | 2950 | 2800 | 240 | 50 | 542 | 0.49 | 68 | 2.02 |
| 4 | DCE | 190 | 7 | 3900 | 350 | 3250 | 2950 | 196 | 100 | 900 | 0.78 | 85 | nm |
| 5 | 50/50 DCE/$CH_2Cl_2$ | 190 | 6 | 2000 | 200 | 1200 | 1100 | 190 | 100 | 489 | 1.03 | 86 | 2.40 |
| 6 | $CH_2Cl_2$ | 145–240 | 25 | 2800 | 200 | 1700 | 1600 | 240 | 100 | 369 | 0.94 | 81 | 3.27 |

Example 7

This example demonstrates flash spinning of 4GT plexifilaments using HCFC-122 as the spin agent. The 4GT polymer used was CRASTIN® 6129 4GT, obtained from DuPont. CRASTIN® 4GT has a melt flow rate of 9 g/10 min measured by standard techniques at a temperature of 250° C. with a 2.16 kg weight, and has a melting point of 225° C. The spin mixture contained 15 weight percent 4GT polymer, based on total weight of the spin mixture, in HCFC-122 spin agent.

Plexifilaments were obtained by flash spinning the spin mixtures using the conditions given in Table 2 below. Plexifilament mechanical properties are also reported in Table 2.

Examples 8–9

In Examples 8 and 9, plexifilaments were flash spun from a spin mixture containing weight percent of 4GT as described in Example 7 in a spin agent of DCE.

Plexifilaments were obtained by flash spinning the spin mixtures using the conditions given in Table 2 below. Plexifilament mechanical properties are also reported in Table 2.

TABLE 2

4GT Plexifilamentary Fibers

| Ex. No. | Solvent | Temp (° C.) | Mixing min | Mixing Back P (psig) | Mixing ΔP (psig) | Spinning Accum P (psig) | Spinning Spin P (psig) | Spinning Temp (° C.) | Fiber Properties @ 10 tpi gms load | Den | Ten (gpd) | E (%) | Modulus (gpd) |
|---|---|---|---|---|---|---|---|---|---|---|---|---|---|
| 7 | HCFC-122 | 190–230 | 5 | 4000 | 600 | 3100 | 2975 | 231 | 100 | 505 | 0.99 | 91 | 4.23 |
| 8 | DCE | 160–200 | 15 | 3200 | 250 | 2475 | 2300 | 200 | 20 | 274 | 0.80 | 49 | nm |
| 9 | DCE | 160–223 | 17 | 3600 | 250 | 2850 | 2700 | 219 | 100 | 359 | 1.09 | 77 | 3.99 |

Examples 10–12

These examples demonstrate flash spinning of 3GT foam. The 3GT polymer as described in Examples 1–3, having an intrinsic viscosity of 1.53 dl/g, was used to prepare spin mixtures containing 50 weight percent 3GT. Cab-o-Sil N70-TS colloidal silica was added to each spin mixture at 1.0 weight percent, based on polymer. The spin agents used were dichloromethane, DCE and HCFC-122 for Examples 10, 11, and 12, respectively.

The spin mixtures were flash spun using the conditions shown in Table 3 to obtain acceptable foam fibers.

TABLE 3

Flash Spinning Conditions for 3 GT Foam

| | | Mixing | | | | Spinning | | |
|---|---|---|---|---|---|---|---|---|
| Example | Solvent | Temp (° C.) | Min | Back P (psig) | ΔP (psig) | Accum P (psig) | Spin P (psig) | Temp (° C.) |
| 10 | $CH_2Cl_2$ | 190 | 30 | 1500 | 800 | 800 | 450 | 191 |
| 11 | DCE | 190 | 35 | 1500 | 1000 | 775 | 325 | 189 |
| 12 | HCFC-122 | 205 | 30 | 1500 | 1000 | 770 | 260–110 | 203 |

Examples 13–16

These examples demonstrate flash spinning of 4GT foams. The 4GT as described in Example 7, was used to prepare spin mixtures containing 50 weight percent 4GT. The spin agents used in Examples 13 and 14 were dichloromethane and DCE, respectively. HCFC-122 was used as the spin agent for Examples 15 and 16. Cab-o-sil N70-TS fumed silica (Cabot Corporation, Boston, Mass.) was added to each spin mixture at 1.0 weight percent, based on polymer. The spin mixtures were flash spun using the conditions shown in Table 4 to obtain acceptable foam fibers.

TABLE 4

Flash Spinning Conditions for 4GT Foam

| | | Mixing | | | | Spinning | | |
|---|---|---|---|---|---|---|---|---|
| Example | Solvent | Temp (° C.) | Min | Back P (psig) | ΔP (psig) | Accum P (psig) | Spin P (psig) | Temp (° C.) |
| 13 | $CH_2Cl_2$ | 190 | 30 | 1500 | 800 | 800 | 350 | 190 |
| 14 | DCE | 190 | 20 | 1500 | 500 | 800 | 275–125 | 190 |
| 15 | HCFC-122 | 190 | 34 | 1500 | 1500 | 800 | 250–150 | 185 |
| 16 | HCFC-122 | 190 | 34 | 1500 | 1500 | 800 | 150–350 | 185 |

Examples 17–18

These examples demonstrate flash spinning of 2GT foams. The 2GT was obtained from DuPont. The 2GT polymer, having an intrinsic viscosity of 0.67 dl/g was solid phase polymerized by heating in nitrogen for 16 hours at 235° C. The solid phase polymerized polymer used in Examples 17 and 18 had an intrinsic viscosity of 1.02 dl/g.

The spin agents used in Examples 17 and 18 were DCE and HCFC-122, respectively. Spin mixtures were prepared containing 50 weight percent 2GT. Weston 619F thermal stabilizer was added to the spin mixture of Example 18 at 0.1 weight percent, based on total spin agent. The spin mixtures were flash spun using the conditions shown in Table 5 to obtain acceptable foam fibers.

TABLE 5

Flash Spinning Conditions for 2GT Foam

| | | Mixing | | | | Spinning | | |
|---|---|---|---|---|---|---|---|---|
| Example | Solvent | Temp (° C.) | Min | Back P (psig) | ΔP (psig) | Accum P (psig) | Spin P (psig) | Temp (° C.) |
| 17 | DCE | 190–240 | 27 | 2000 | 200 | 1200 | 900 | 190 |
| 18 | HCFC-122 | 210–255 | 29 | 2000 | 400 | 1200 | 800–1125 | 210 |

Example 19

This example demonstrates flash spinning of a 3GT copolymer containing isophthalate units. The copolymer was prepared using methods known in the art by polymerizing 1,3-propanediol, dimethyl terephthalate, and dimethyl isophthalate using TYZOR®TPT tetraisopropyl titanate as the polycondensation catalyst. The dimethyl isophthalate was added in an amount equal to 5 mole percent of the total dimethyl terephthalate and dimethyl isophthalate. The as-prepared copolymer (intrinsic viscosity of 0.72 dl/g) was solid phase polymerized under nitrogen at 205° C. to obtain an intrinsic viscosity of 1.69 dl/g.

The spin mixture was prepared containing 20 weight percent of the above-described copolymer in HCFC-122 spin agent. The mixing temperature was 210° C., and the mixing time was 10 minutes at a back pressure of 4000 psig and a pressure differential of 250 psig. The solution was flash spun at 211° C. and a spin pressure of about 3000 psig with an accumulator pressure of 3275 psig. The resulting plexifilaments had a denier of 1032 under 100 grams load, modulus of 2.36 grams per denier, tenacity of 1.17 grams per denier, and a percent elongation of 104%.

Example 20

This example demonstrates flash spinning of a 3GT copolymer containing isophthalate units using dichloromethane as the spin agent. The copolymer was prepared using methods known in the art with dimethyl isophthalate added in an amount equal to 5 mole percent of the total dimethyl terephthalate and dimethyl isophthalate. The copolymer was solid phase polymerized under nitrogen to obtain an intrinsic viscosity of 1.49 dl/g.

A spin mixture was prepared containing 20 weight percent of the 3GT copolymer in dichloromethane spin agent. The mixing temperature was 240° C., and the mixing time was 7 minutes at a back pressure of 3000 psig and a pressure differential of 200 psig. The solution was flash spun at a temperature of 241° C. and a spin pressure of 1650 psig with an accumulator pressure of 1800 psig. The resulting plexifilaments had a denier of 584 under 100 grams load, modulus of 4.24 grams per denier, tenacity of 0.89 grams per denier, and a percent elongation of 102%.

Examples 21–23

These examples demonstrate flash spinning of a polymer blend of 3GT and high density polyethylene using dichloromethane as the spin agent. In each example the dichloromethane was present at 80 wgt. % of the spin mixture and the 3GT/polyethylene blend was present at about 20 wgt. %.

The 3GT polymer described in Examples 1–3, having an intrinsic viscosity of 1.53 dl/g was used in these examples. High density polyethylene having a melt index of 0.75 g/10 min (measured according to ASTM D1238 at 190° C. and 2.16 kg load) and a density of 0.95 g/cm$^3$ was mixed with 3GT and the dichloromethane spin agent to prepare the spin mixtures. The polyethylene was Alathon®, obtained from Equistar Chemicals LP of Houston, Tex.

The spin mixture of Example 21 contained 30 weight percent 3GT and 70 weight percent high density polyethylene, based on the total weight of the blend.

The spin mixture of Example 22 contained 50 weight percent 3GT and 50 weight percent high density polyethylene, based on the total weight of the blend.

The spin mixture of Example 23 contained 70 weight percent 3GT and 30 weight percent high density polyethylene, based on the total weight of the blend.

The mixing temperature was 225° C., and the mixing time was 20 minutes at a back pressure of 2500 psig and a pressure differential of 250 psig. Spinning conditions and plexifilament properties are given in Table 6.

TABLE 6

Flash Spinning Conditions for 3GT/Polyethylene Blends

| | Spinning | | | Fiber Properties @ 10 tpi | | | | |
|---|---|---|---|---|---|---|---|---|
| Ex. No. | Accum P (psig) | Spin P (psig) | Temp (° C.) | gms load | Den | Ten (gpd) | E (%) | Modulus (gpd) |
| 21 | 1100 | 850 | 223 | 50 | 294 | 3.46 | 119 | 3.94 |
| 22 | 900 | 750 | 227 | 50 | 221 | 3.51 | 107 | 4.4 |
| 23 | 1100 | 975 | 224 | 50 | 271 | 1.95 | 116 | 2.66 |

Examples 24–40

These examples demonstrate flash spinning blends of 2GT, 3GT or 4GT and high density polyethylene using dichloroethylene as the spin agent. High density polyethylene having a melt index of 0.75 g/10 min (measured according to ASTM D1238 at 190° C. and 2.16 kg load) and a density of 0.95 g/cm$^3$ was mixed with polyester and the dichloroethylene spin agent to prepare the spin mixtures. The polyethylene was Alathon®, obtained from Equistar Chemicals LP of Houston, Tex. In each of the examples, the polyester and the polyethylene were present in the blend at 50/50 (wgt/wgt). In each of the examples the dichloroethylene was present at about 80 wgt. % of the total spin mixture and the polyester/polyethylene blend was present at about 20 wgt. %.

The 2GT was as described in Examples 17–18. The 3GT copolymer was described in Example 20 was used in Examples 30–32. The 4GT polymer was CRASTIN® 6129 4GT as first described in Example 7.

Mixing and spinning conditions and resultant plexifilament properties are presented in Table 7, below.

Example 41

The spin mixture was prepared containing 25 weight percent of 2GT in a spin agent of 85/15 (wgt/wgt) dichloromethane/DCE. The 2GT was solid-phase polymerized Crystar® 5005sc 656 with an intrinsic viscosity of 1.3. Crestar® is a registered trademark of and available from DuPont. Mixing was started at 150° C. and continued for 45 minutes, and then raised to 220° C. for a total mixing time of 67 minutes. The mixing pressure was 3000 psig throughout. The solution was flash spun at 221° C. and a spin pressure of about 1625 psig with an accumulator pressure of 1800 psig. The resulting plexifilaments had a denier of 806 under 40 grams load, modulus of 8.8 grams per denier, tenacity of 0.95 grams per denier, and elongation of 80%.

TABLE 7

Flash Spinning Conditions for 2GT, 3GT and 4GT/Polyenthylene Blends

| | | Mixing | | | | Spinning | | | Fiber Properties @ 10 tpi | | | | |
|---|---|---|---|---|---|---|---|---|---|---|---|---|---|
| Ex. No. | Blend | Temp (° C.) | min | Back P (psig) | ΔP (psig) | Accum P (psig) | Spin P (psig) | Temp (° C.) | gms load | Den | Ten (gpd) | E (%) | Modulus (gpd) |
| 24 | 2GT/PE | 220 | 5 | 2500 | 600 | 1400 | 1350 | 220 | 100 | 314 | 2.45 | 107 | 8.24 |
| 25 | 2GT/PE | 210 | 5 | 2500 | 600 | 1400 | 1250 | 210 | 40 | 581 | 1.46 | 89 | 6.77 |
| 26 | 2GT/PE | 210 | 10 | 2500 | 600 | 950 | 750 | 211 | 100 | 410 | 3.04 | 110 | 13.3 |
| 27 | 2GT/PE | 210 | 10 | 2500 | 700 | 1700 | 1450 | 211 | 100 | 478 | 3.04 | 125 | 8 |
| 28 | 2GT/PE | 210 | 10 | 2500 | 700 | 1550 | 1250 | 210 | 100 | 440 | 2.92 | 118 | 8.75 |
| 29 | 2GT/PE | 210 | 10 | 2500 | 600 | 1900 | 1600 | 210 | 100 | 420 | 2.44 | 111 | 2.26 |
| 30 | 3GT*/PE | 230 | 10 | 2500 | 600 | 1100 | 975 | 231 | 40 | 202 | 2.15 | 96 | 7.12 |
| 31 | 3GT*/PE | 220 | 5 | 2500 | 700 | 1100 | 700 | 219 | 40 | 682 | 0.86 | 261 | 2.1 |
| 32 | 3GT*/PE | 210 | 10 | 2500 | 600 | 1100 | 750 | 211 | 40 | 526 | 1.03 | 103 | 2.91 |
| 33 | 4GT/PE | 230 | 10 | 2500 | 700 | 1100 | 950 | 233 | 40 | 215 | 2.11 | 64 | 6.7 |
| 34 | 4GT/PE | 210 | 10 | 2500 | 700 | 950 | NA | 211 | 40 | 317 | 1.87 | 99 | 6.23 |
| 35 | 4GT/PE | 210 | 10 | 2500 | 700 | 1400 | 1250 | 212 | 100 | 327 | 3.53 | 101 | 14.7 |
| 36 | 4GT/PE | 210 | 10 | 2500 | 700 | 1700 | 1300 | 210 | 40 | 654 | 2.22 | 125 | 6.69 |
| 37 | 4GT/PE | 210 | 10 | 2500 | 600 | 1300 | 1000 | 210 | 40 | 540 | 1.92 | 111 | 4.89 |
| 38 | 4GT/PE | 210 | 10 | 2500 | 700 | 1500 | 750 | 209 | 40 | 546 | 2.31 | 120 | 6.24 |
| 39 | 4GT/PE | 220 | 5 | 2500 | 700 | 1100 | NA | 220 | 100 | 284 | 3.53 | 111 | 8.16 |
| 40 | 4GT/PE | 210 | 10 | 2500 | 700 | 1100 | 750 | 209 | 40 | 413 | 2.15 | 109 | 5.80 |

*These examples included 5 mole % dimethyl isophthalate.

What is claimed is:

1. Plexifilamentary film-fibril strands, consisting of poly (1,3-propylene terephthalate) and copolymers thereof.

2. Plexifilamentary film-fibril strands, consisting of a blend of poly(1,3-propylene terephthalate) and copolymers thereof with a polyolefin selected from the group consisting of polyethylene and polypropylene.

3. The plexifilamentary film-fibril strands of claim 2, wherein the poly(1,3-propylene terephthalate) is present at 95 to 5 wgt % and the polyolefin is present at 5 to 95 wgt %, based on the weight of the blend.

4. Plexifilamentary film-fibril strands, consisting of poly (1,3-propylene terephthalate) and copolymers thereof made by flash spinning in a spin agent selected from the group consisting of 1,1,2-trichloro-2,2-difluoroethane, isomers thereof; 1,2-dichloroethylene; and dichloromethane.

5. Plexifilamentary film-fibril strands, consisting of a blend of poly(1,3-propylene terephthalate) and copolymers thereof with a polyolefin selected from the group consisting of polyethylene and polypropylene made by flash spinning in a spin agent of dichloromethane.

6. The plexifilamentary film-fibril strands of claim 5, wherein the poly(1,3-propylene terephthalate) is present at 95 to 5 wgt % and the polyolefin is present at 5 to 95 wgt %, based on the weight of the blend.

* * * * *